US009702170B2

(12) United States Patent
Favier

(10) Patent No.: US 9,702,170 B2
(45) Date of Patent: Jul. 11, 2017

(54) HOOKED DEVICE FOR MARKING COMMERCIAL ARTICLES

(71) Applicant: EXAQTWORLD, Joinville le Pont (FR)

(72) Inventor: Alain Favier, Nogent sur Marne (FR)

(73) Assignee: EXAQTWORLD, Joinville le Pont (FR)

( * ) Notice: Subject to any disclaimer, the term of this patent is extended or adjusted under 35 U.S.C. 154(b) by 0 days.

(21) Appl. No.: 14/906,710

(22) PCT Filed: Jul. 22, 2014

(86) PCT No.: PCT/FR2014/051889

§ 371 (c)(1),
(2) Date: Jan. 21, 2016

(87) PCT Pub. No.: WO2015/011401

PCT Pub. Date: Jan. 29, 2015

(65) Prior Publication Data

US 2016/0163233 A1 Jun. 9, 2016

(30) Foreign Application Priority Data

Jul. 22, 2013 (FR) ..... 13 57196

(51) Int. Cl.
*E05B 63/00* (2006.01)
*E05B 73/00* (2006.01)
(Continued)

(52) U.S. Cl.
CPC ..... *E05B 73/0029* (2013.01); *E05B 39/002* (2013.01); *E05B 39/005* (2013.01);
(Continued)

(58) Field of Classification Search
CPC ..... E05B 39/00; E05B 39/002; E05B 39/005; E05B 67/10; E05B 73/0017;
(Continued)

(56) References Cited

U.S. PATENT DOCUMENTS 2,356,856 A * 8/1944 Komenak ..... G09F 3/0305 292/318
5,426,419 A * 6/1995 Nguyen ..... E05B 73/0017 340/572.9

(Continued)

*Primary Examiner* — Christopher Boswell
(74) *Attorney, Agent, or Firm* — Ipsilon USA, LLP

(57) ABSTRACT

The invention concerns a device for marking a commercial article, comprising two separable parts:
- a first part (12) including an axial spike (14),
- a second part comprising an orifice for axial insertion of the spike and means for locking the spike inserted in said orifice.

One of the parts, referred to as the attachment part, comprises an attachment: member (32) that is able to pivot between a first position in which a free end of the member is far away from the attachment part and a second position in which the free end is disposed in a housing (50) of the attachment part. The attachment part is configured so that the free end (32*a*) of the attachment member is blocked in the housing (50; 108) by the presence of the other part of the device that is locked to the attachment part by way of the spike (14) and its locking means.

26 Claims, 7 Drawing Sheets

(51) Int. Cl.

| | |
|---|---|
| ***G08B 13/24*** | (2006.01) |
| ***G09F 3/03*** | (2006.01) |
| ***G09F 3/12*** | (2006.01) |
| ***G09F 3/14*** | (2006.01) |
| ***G09F 3/20*** | (2006.01) |
| ***G09F 7/06*** | (2006.01) |
| ***E05B 67/10*** | (2006.01) |
| ***E05B 39/00*** | (2006.01) |

(52) U.S. Cl.
CPC ..... *E05B 67/10* (2013.01); *E05B 73/0017* (2013.01); *G08B 13/2434* (2013.01); *G09F 3/0305* (2013.01); *G09F 3/0335* (2013.01); *G09F 3/0347* (2013.01); *G09F 3/0376* (2013.01); *G09F 3/12* (2013.01); *G09F 3/14* (2013.01); *G09F 3/207* (2013.01); *G09F 7/06* (2013.01)

(58) Field of Classification Search
CPC ..... E05B 73/0029; G09F 3/03; G09F 3/0305; G09F 3/0347; G09F 3/0376; G09F 3/12
See application file for complete search history.

(56) References Cited

U.S. PATENT DOCUMENTS

| | | | | |
|---|---|---|---|---|
| 5,524,463 | A * | 6/1996 | Schenkel | E05B 73/0017 24/16 PB |
| 6,052,876 | A * | 4/2000 | Hogan | E05B 73/0017 24/704.1 |
| 6,226,839 | B1 * | 5/2001 | Sayegh | B65D 63/06 24/16 PB |
| 7,342,495 | B2 * | 3/2008 | Sayegh | E05B 73/0017 24/704.1 |
| 7,453,370 | B2 * | 11/2008 | Marsilio | E05B 45/005 340/568.1 |
| 7,518,521 | B2 * | 4/2009 | Feibelman | E05B 73/0017 340/568.2 |
| 8,573,011 | B2 * | 11/2013 | Thoonsen | E05B 73/0017 206/1.5 |
| 8,701,317 | B2 * | 4/2014 | Le Devehat | A01K 11/001 40/302 |
| 9,293,020 | B2 * | 3/2016 | Nguyen | G08B 13/2434 |
| 2013/0247337 | A1 * | 9/2013 | Zimmel | B65C 7/001 24/367.1 |

* cited by examiner

HOOKED DEVICE FOR MARKING COMMERCIAL ARTICLES

RELATED APPLICATIONS

This application is a National Phase Application of PCT/FR2014/051889, filed on Jul. 22, 2014, which in turn claims the benefit of priority from French Patent Application No. 13 57196 filed on Jul. 22, 2013, the entirety of which are incorporated herein by reference.

BACKGROUND

Field of the Invention

The invention concerns a device for marking a commercial article.

In the sector of the sale of commercial articles in shops, it is known to use devices in two parts fixed to the articles in order to identify/mark them and/or to protect them against theft.

Description of Related Art

Such devices generally comprise two parts including a first part that includes a spike intended to be inserted in an orifice of a second part. The second part includes means for locking the spike in order to prevent its withdrawal once it has been inserted in the orifice.

Such a device is more particularly used by piercing the commercial article with the spike of the first part and inserting this spike in the orifice of the second part in order to lock it there.

The article is therefore trapped between the two parts of the device until it reaches the checkout of the shop.

The device may bear information identifying/marking the article such as information on the article and/or the trade mark under which is sold.

The device may include one or more anti-theft security members. For example, such members cooperate with gates located at the entrances and exits of the shop in order to detect any attempt to remove the article from the shop fraudulently and to emit an alarm.

Although satisfactory, these devices are however not suitable for fixing to articles that are only slightly or not at all suitable for being pierced by a spike, such as sports shoes, leather goods such as belts, handbags, etc.

OBJECTS AND SUMMARY

It would therefore be of interest to be able to use a two-part device that can be fixed to a commercial article that is not very or at all suitable for being pierced by a spike.

A first aspect of the invention therefore consists in a device for marking a packaged or unpackaged commercial article, the device comprising two separable parts:

- a first part that includes an axial spike,
- a second part that includes an orifice for the axial insertion of the spike and locking means that are able to lock the spike of the first part inserted axially in said orifice and to prevent its axial withdrawal, characterized in that one of the two parts, referred to as the attachment part, includes a rigid attachment member that includes a body having a free first end and an opposite second end fixed in an articulated and permanent manner to the attachment part, the free first end being able to pivot freely about the second and in the absence of the other part of the device between a first position in which the free first end is far away from the attachment part and a second position in which the free first end is disposed in a housing of the attachment part that is far away from the spike or the orifice for axial insertion of the spike, the attachment part being configured so that the free first end of the attachment member is blocked in the housing and prevented from pivoting by the presence of the other part of the device that is locked to the attachment part by way of the spike and its locking means.

This device can therefore retain the same principle as a prior art two-part marking device and be fixed or attached to a commercial article in a locked manner without the spike perforating the article or its packaging. For example, the part of the device that is not the attachment part may be unmodified compared to a prior art device, only the attachment part necessitating specific means (the attachment member) to provide the aforementioned function. The attachment part is of relatively simple design as it does not employ a supplementary mechanism to prevent the end of the attachment member leaving the housing. Indeed, it is the other part of the marking device that, when it is positioned in front of the housing in the position locked to the attachment part (via the conventional locking/retaining means), that prevents the free end of the attachment member leaving the housing. The two parts are unlocked in the conventional manner with a known tool such as a permanent magnet. Depending on the type of means for locking the spike, the unlocking system or tool may be different from that cited above and of a type known in the field of anti-theft devices.

When the attachment part has not yet been assembled to the other part of the device the body of the free first end of the attachment member can surround a portion of an article (e.g. belt buckle, bag strap, shoe eyelet, buttonhole, etc.).

Once the body is surrounding the portion of the article, the free first end of the member pivots relative to the attachment part and notably the fixed second end of the member in order to penetrate into the housing that is reserved for it. This makes it possible to trap the portion of the article inside the loop formed by the body of the member that is arranged externally of the attachment part.

As the free first end of the member is pushed into its housing, the loop formed in this way is closed, which prevents the portion of the article from leaving the loop and being released.

The other part of the device is then moved toward the attachment part and the axial spike is inserted axially in the orifice until the means for locking the spike prevent axial withdrawal of the inserted spike.

The device in accordance with the invention is of particularly simple design and particularly simple to use.

Indeed, it includes only two parts because the attachment member that is mobile in rotation relative to the attachment part is permanently connected to the attachment part by its second end. The user cannot remove this second end, which is mounted so as to be trapped inside the attachment part. It is therefore a simple matter to attach an article, with only one hand holding the attachment part and the free first end in a position far away from the latter (attachment member in open position).

The user then pivots the attachment member to bring the free first end against the attachment part with the article trapped in the loop formed by the body (closed position). Alternatively, it is the attachment part alone that pivots, or even the attachment part and the attachment member that pivot toward each other.

Thus use of the device necessitates few operations and the latter are particularly simple.

Moreover, it is a simple matter to pivot the attachment member because it is guided by the design of the rigid attachment member and its mobility relative to the attachment member. The user therefore does not need to aim at the housing to introduce into it the free end of the attachment member.

The user can merely manipulate the body of the member outside the attachment part to produce the pivoting movement with only one hand. They therefore do not need to place their fingers near the spike.

Moreover, the housing being far away from the spike, even if the user presses on the free end of the member to introduce it into its housing there is no risk of them being injured by the spike.

It will be noted that the rigid attachment member is of purely mechanical design.

It therefore includes no electrical and/or electronic component and the closure of the attachment member when the free first end is disposed at the bottom of its housing does not make or break any electrical contact.

The rigid member is made from metal wire, for example, for example hardened steel (like hooks or padlock shackles).

In accordance with other possible features, separately or in combination:

- the attachment member has the general shape of a hook;
- the second and of the attachment member is mounted so that it is free to rotate about its axis inside a cavity of the attachment part and is retained axially in position in said cavity;
- the body of the attachment member that is outside the attachment part is joined to the second end through an opening of the attachment part that leads into the cavity;
- the housing for the first end and the cavity for the second end are arranged in a parallel manner;
- the housing for the first end and the cavity for the second end are oriented in respective non-parallel directions;
- the housing of the attachment part includes an opening through which the free first end of the attachment member is able to penetrate into said housing and free to leave it in the absence of the other part of the device;
- the opening of the housing is on a face of the attachment part, the other part of the device facing said face when it is locked to said attachment part;
- the rotation axis of the second end of the attachment member is Contained in a plane substantially parallel to that in which the opening lies;
- the two parts of the device are configured so that when they are locked together the interface between said parts that is perpendicular to the axial spike is protected from the outside by an axial extension fastened to one of the parts that surrounds said interface; the axial extension, such as an annular rim, borders the interface and therefore prevents access to the interface by sliding a tool between the two parts (more specifically between their two facing faces) to force them apart and thereby to access the spike, which could be cut; it will be noted that in the locked position the two facing faces of the two parts of the device are very close together, even virtually in contact with each other;
- the spike is blunted; this is possible because the spike no longer needs to be as thin as possible so that it can pass through an article without spoiling it; the spike in fact serves only to assemble the two parts in a locked manner; blunting the spike therefore reduces the risk of pricking the fingers when manipulating the first part including the spike;
- the attachment member comprises a first portion including the opposite first and second ends and a curved second portion that extends from the first portion and forms the body of the attachment member; the curved second portion having the free first end imparts a hook, loop or hoop general shape to the locking member that enables it to be inserted in holes, openings, passages of an article such as the holes in a belt, a belt buckle or keeper or the eyelets of a shoe or around a strap (for example of a bag);
- the curved second portion lies in a plane that coincides with the plane in which the first portion lies;
- the curved second portion lies in a plane that is inclined relative to the plane in which the first portion lies; this arrangement facilitates placement of the device on some articles; this arrangement also facilitates unlocking the device at the checkout: of a shop and unlocking it on a decoupling device, notably for bulky/large articles such as handbags;
- the curved second portion of the attachment member has a circular arc or hoop shape;
- the free first and of the attachment member includes an end portion curved to form a retaining element intended to cooperate with the housing of the attachment part;
- the attachment part is the first part of the device, which includes a spike;
- alternatively, the attachment part is the second part of the device, which includes the means for locking the spike;
- the device is an anti-theft protection device;
- at least one of the two parts includes at least one active or passive member that is able to emit electromagnetic waves to the outside of the device or to receive electromagnetic waves from the outside of the device; said at least one active or passive member provides at least a portion of the anti-theft function; the other portion being possibly provided by a complementary system such as a walk through detector placed at the entrance to a shop;
- said at least one active or passive member is housed in the other part of the device;
- one of the two parts contains an ink reservoir that is able to release ink in the event of attempted axial withdrawal of the spike from the second part.

In accordance with a second aspect, the invention consists in a device for marking a packaged or unpackaged commercial article, device including an axial spike and a rigid attachment member intended for attaching the device to a commercial article or to its packaging, the attachment member including a body having a free first end and an opposite second end fixed in an articulated and permanent manner to the device, the free first end being able to pivot about the second end between a first position in which the free first end is far away from the device and a second position in which the free first end is disposed in a housing of the device that is far away from the axial spike, the free first end being able to pass freely from one position to the other during its pivoting movement.

This device corresponds to the attachment part of the marking device in accordance with the aforementioned first aspect and has the same features and advantages, which are therefore not repeated here.

In accordance with one possible feature, the axial spike is intended to cooperate with and to be locked to a device complementary to the marking device, the free first end being able to pass freely from one position to the other when the axial spike is not cooperating with said complementary device.

BRIEF DESCRIPTION OF THE DRAWINGS

Other features and advantages will become apparent in the course of the following description, given by way of nonlimiting example only and with reference to the appended drawings, in which.

DETAILED DESCRIPTION

Figure 1:
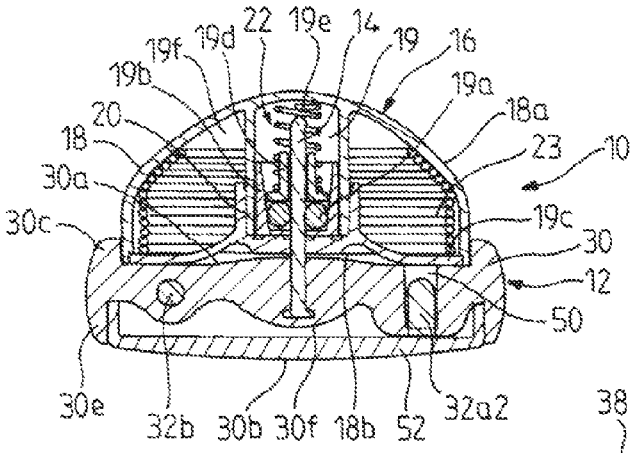
FIG. 1 is a view in axial section of a device in accordance with a first embodiment of the invention.
Figure 2:
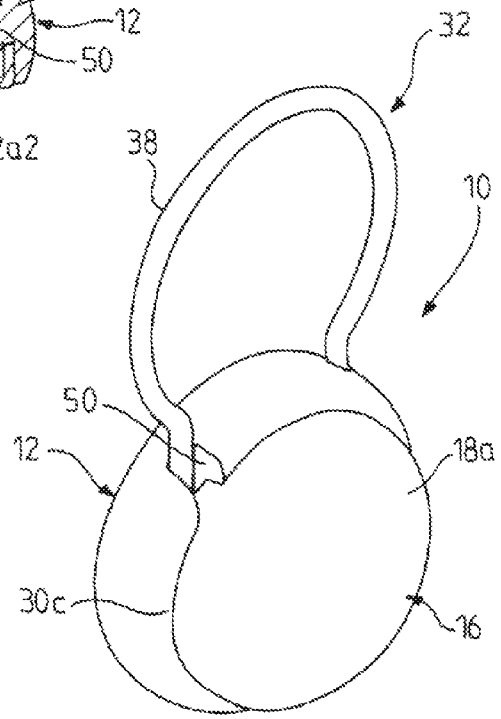
FIG. 2 is a perspective view of the device from FIG. 1.
Figure 3:
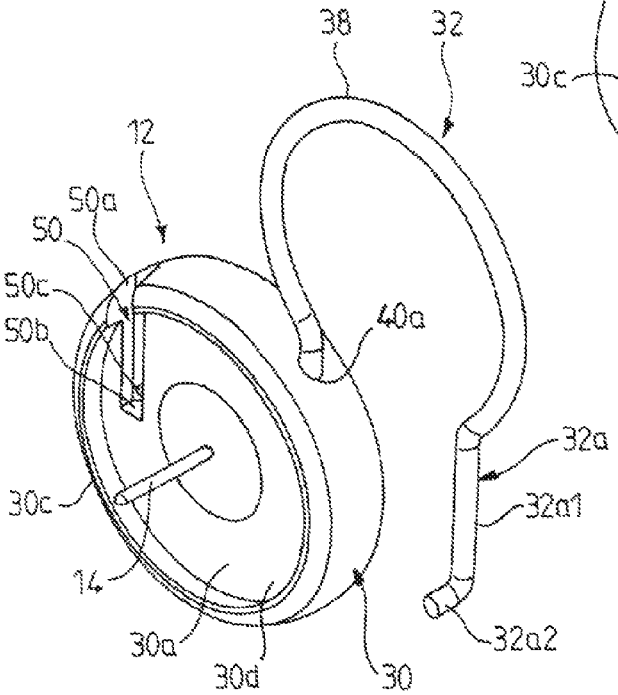
FIG. 3 is a perspective view of the attachment part of the device from FIG. 1 with the attachment member in the open position.

As shown in FIGS. 1 to 3, a device 10 intended to be fixed/attached in a locked manner to a commercial article or to the packaging that contains it is formed of two parts that can be separated from each other:

- a first part 12, referred to as the attachment part, that is provided with an axial spike 14,
- a second part 16 that comprises, on the one hand, a body 18 including an orifice 20 for the axial insertion of the spike 14 into the interior of the body and, on the other hand, means 22 for axially locking or retaining the spike when the latter is inserted into the body via the orifice. These locking means 22 prevent axial withdrawal of the spike once inserted. These means are conventional and consist of ball-type locking means, for example.

The body 18 of the device 10 encloses a central cavity 19 in which are disposed the aforementioned ball-type locking means or other known locking means. A plurality of balls 19*a* are placed in a part forming a funnel 19*b* inside the cavity, in the same plane and forming between them a central space to receive the spike 14. The body also includes a plate 19*c*, for example a substantially plane plate, that blocks access to the internal portion of the body. The central orifice 20 for insertion of the spike is formed in the plate 19*c*. When the spike is inserted in this orifice and into the central space between the balls, the balls are locked in the convergent portion of the funnel. Any attempt at axial withdrawal of the spike tends to push the balls farther into the convergent portion of the funnel and therefore to lock the spike (locked position of the two elements of the device trapping a commercial article between them). The balls are mounted on an amagnetic material support 19*d* which is mounted on amagnetic material spring means such as a spring 19*e*. The spring means exert on the support 19*d* and therefore on the balls an axial force that tends to push them farther into the narrowest portion of the funnel 19*b*. It will be noted that the balls are made from a magnetic material.

The spike can only be unlocked and the two parts 12 and 16 can only be decoupled or disassembled by an unlocking tool, referred to as a decoupler, which includes at least one permanent magnet.

The balls may be extracted from the convergent portion of the funnel by the action of the external magnetic field generated by the permanent magnet when the axis of alignment of the funnel, the balls and the spring means coincides with the axis of the magnetic field.

In the FIG. 1 position, the two parts 12 and 16 are locked together and therefore cannot be separated without the appropriate tool.

In the present embodiment, the second part 16 is identical to that of a conventional device marketed by the company EXAQTWORLD and described in French patent application n° 2 947 087, for example.

The device 10 is for example a device for marking or identifying the article to which it is fixed and to this end includes information identifying the article or even the price. This information is carried by the device and is written/printed thereon for example or on an element (e.g. label, film, etc.) applied to or integrated into the device. For example, the information may be protected by a transparent protection interface such as an adhesive film, a window or a cap mounted on the device.

An example of a marking device is described in the aforementioned French patent n° 2 947 087. The information thereon is printed on an element in the form of a token that is added to the portion of the device referred to as the head and including the spike. The added element is protected by a transparent cap. The information on the article is therefore inaccessible from the outside, which is notably advantageous for price and/or promotional information that cannot be falsified as they could be on a label.

It will be noted that the device may additionally or alternatively include an optically readable code such as a flash code representing information on the article, the trade mark under which it is sold, the shop or the chain of shops in which it is sold.

The code represent the address of a website or a web page related to the aforementioned information, for example.

The identification information is carried by the attachment part 12, for example.

In the present embodiment, the device 10 is also an anti-theft badge or device that is fixed in a locked manner to an article in order to prevent it from being shoplifted.

The body 18 moreover also includes at the periphery of the central cavity 19 an annular chamber 19*f* containing a member 23 or a plurality of members, for example a passive member or passive members. A passive member is able to receive electromagnetic waves coming from a source external to the device. Such a member may take the form of an LC type resonant circuit, for example.

Alternatively, the body 18 may enclose one or more active members, i.e. members that are able to emit and receive electromagnetic waves to and from the outside of the device. Such active or passive members are for example coils with a ferrite core, with or without a capacitor, LCR circuits, magnetic filaments, RFID or NFC type circuits provided with an active or passive memory chip, electronic microsensors, etc. By the transmission of electromagnetic waves, such members cooperate with a detection system, such as a gate or an antenna, placed at a point of access to the shop in which the article to be protected is on sale, in order to trigger an alarm in the event of detection of the device at the level of the access point. The presence of such members adds an anti-theft function to the identification/marking device. However, this function is merely optional in respect of the implementation of the invention. Alternatively, such members are disposed in the attachment part 12 of the device.

As shown in FIGS. 1 and 2, the body 18 has a hemispherical general shape, i.e. is domed on one face 18*a* and substantially plane on the opposite face 18*b* that is the exterior face of the plate 19*c*.

The attachment part 12 shown in perspective in FIG. 3 (separated from the part 16) comprises a body 30, of disk general shape, for example, having two opposite faces 30*a*, 30*b* of which only the interior face 30*a* is represented in this figure. The exterior face 30*b* is represented in FIG. 1.

The head of the spike 14 is housed in the body 30 (FIG. 1) and extends perpendicularly away from the face 30*a* along the axis of said spike (FIG. 3).

The body 30 includes an axial extension or annular rim 30*c* at the periphery of the face 30*a* to form an open central recess 30*d* around the spike 14 and bordered by the rim 30*c*.

The dimensions (e.g. diameter) of this recess 30*d* correspond to the outside dimensions (e.g. diameter) of the second part (16) so as to allow the latter to be inserted in the recess as shown in FIG. 1.

In the FIG. 1 position, the spike 14 is locked into the body 18 of the second part 16 and the two faces 18*b* and 30*a* face each other and lie against each other or in any event lie as close together as possible.

The annular rim or skirt 30*c* extends along a portion of the external wall (face 18*a*) on the second part 16 and therefore beyond the interface area between the respective facing faces 18*b* and 30*a* of the two parts.

The annular rim 30*c* therefore protects access to this interface area and prevents the introduction of a tool/object between the two faces 18*b* and 30*a* with the aim of breaking off the spike.

It will be noted that the axial extension 30*c* is optional.

The attachment part 12 shown in FIG. 3 also includes an attachment member 32 that is substantially hook-shaped and is mounted in a mobile manner on the body 30.

Figure 4:
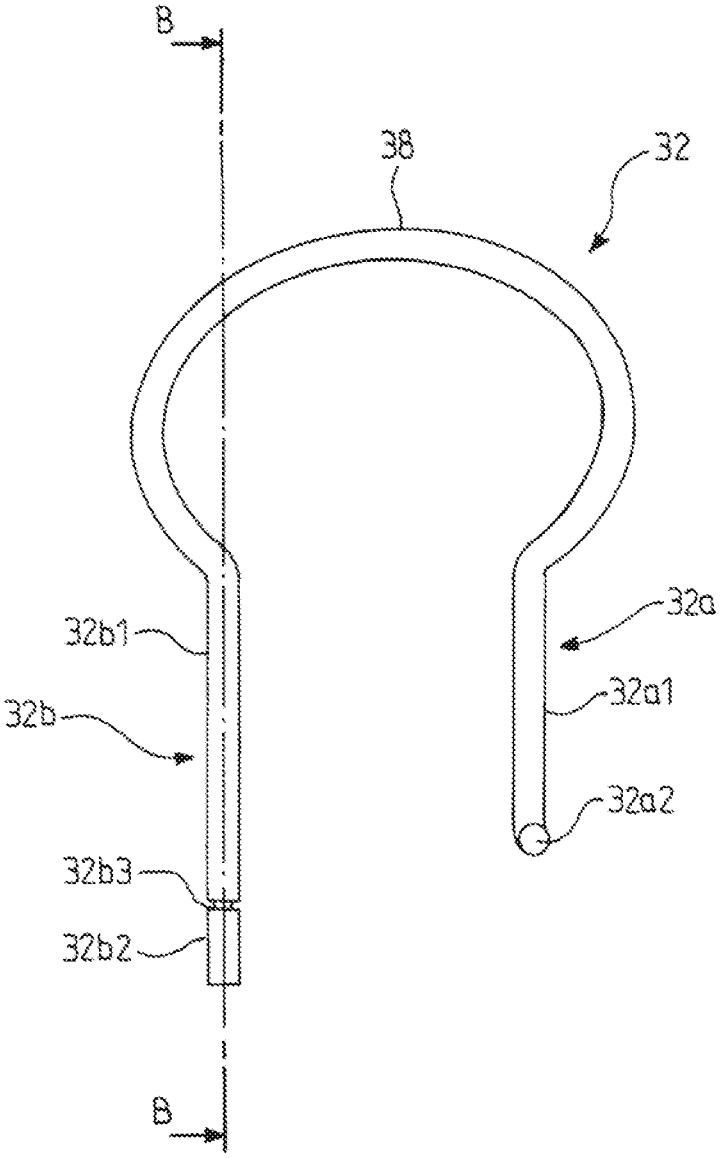
FIG. 4 is a front view of the attachment member of the attachment part from FIG. 3.

The attachment member 32 is shown separately in FIG. 4.

It comprises a body that has two has two opposite ends 32*a* and 32*b*.

To be more specific, the member 32 comprises a first portion that is formed by the two substantially rectilinear and spaced opposite ends 32*a*, 32*b*.

The two ends 32*a* and 32*b* are enclosed within the body 30 of the attachment part 12 and inaccessible from the outside when the device is locked (FIGS. 1 and 2).

The member 32 includes a curved second portion 38 forming the body of the member that extends from and joins the two opposite ends 32*a*, 32*b*.

The curved second portion 38 is of substantially circular arc shape, subtends an angle of more than 180° and is coplanar with the two ends 32*a*, 32*b*.

In FIG. 3, the curved portion 38 has a diameter substantially identical to that of the body 30. However, this diameter may be reduced or increased as required. The circular shape may also be modified, and may be elliptical, for example, or, generally speaking, assume a curved or uncurved shape, regular (e.g. rectangular or square) or otherwise.

When the device is locked (FIG. 2) only the body 38 of the member 32 that lies outside the attachment part 12 can be seen from the outside.

The so-called free first end 32*a* (FIGS. 3 and 4) primarily comprises a rectilinear section 32*a*1 that extends from the curved second portion 38 to an end portion 32*a*2. This end portion 32*a*2 is curved perpendicularly to the plane containing the two ends 32*a*, 32*b* and the curved portion 38.

As shown in FIG. 4, the second end 32*b* includes a rectilinear section 32*b*1, parallel to the section 32*a*1, extending from the curved second portion 38 to an end portion 32*b*2.

The end portion 32*b*2 is separated from the second 32*b*1 by a groove or smaller cross-section portion 32*b*3.

Figure 5:
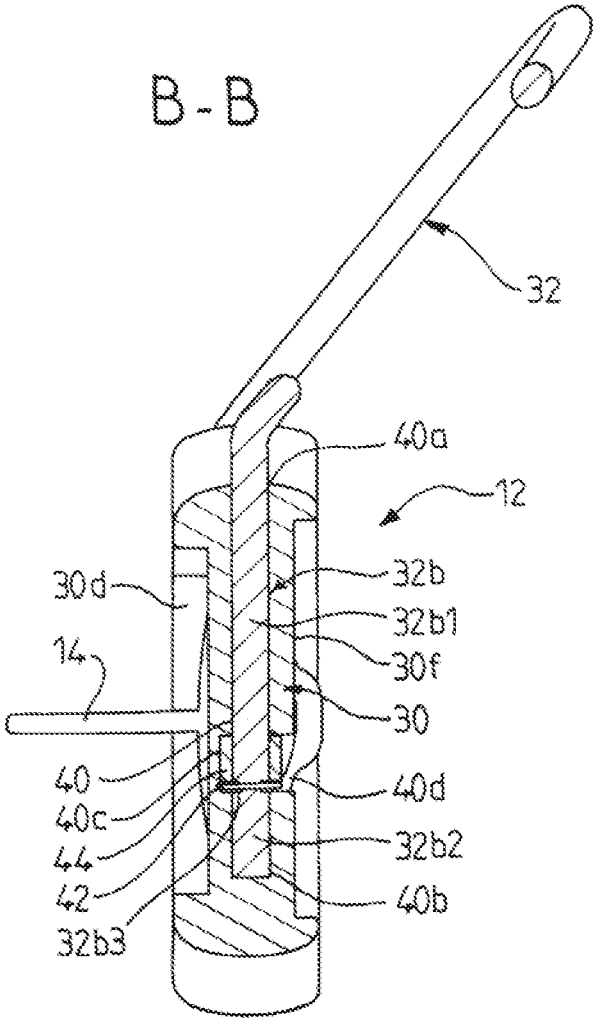
FIG. 5 is a view in axial section of a device incorporating the attachment member from FIG. 4.

FIG. 5 (axial section of the attachment part 12) shows the arrangement of the second end 32*b* in an axial cavity 40 of the body 30 of the attachment part 12. This cavity is perpendicular to the axis of the spike 14 and is open on one side 40*a* for the end 32*b*1 to pass through it.

The cavity 40 is also open laterally, in the vicinity of its opposite side 40*b*, in an area 40*c* of increased diameter that is designed to receive an assembly for axial retention of the end 32*b* in its cavity.

This assembly comprises a washer 42 arranged in the groove 32*b*3 and a sheath 44 disposed around the area of the end 32*b* that is adjacent the groove 32*b*3 (this area is disposed between the groove 32*b*3 and the side 40*a*) and therefore the washer 42.

The assembly 42, 44 assembled in this way is disposed facing the lateral opening 40*d* that enables this assembly to be effected.

This assembly of very simple design prevents withdrawal of the end 32*b* from the cavity 40 along the axis thereof (this axis also forms the rotation axis of the member 32) but allows it to rotate on itself inside said cavity to allow the attachment member (and its first end 32*a*) to pivot from one position to the other.

The attachment member is for example made from metal wire conformed by bending it to the required hook shape. The metal is for example hardened steel of the type used for padlocks. The diameter of the wire varies from 2 to 3 mm and is for example of 2 mm.

Figure 6:
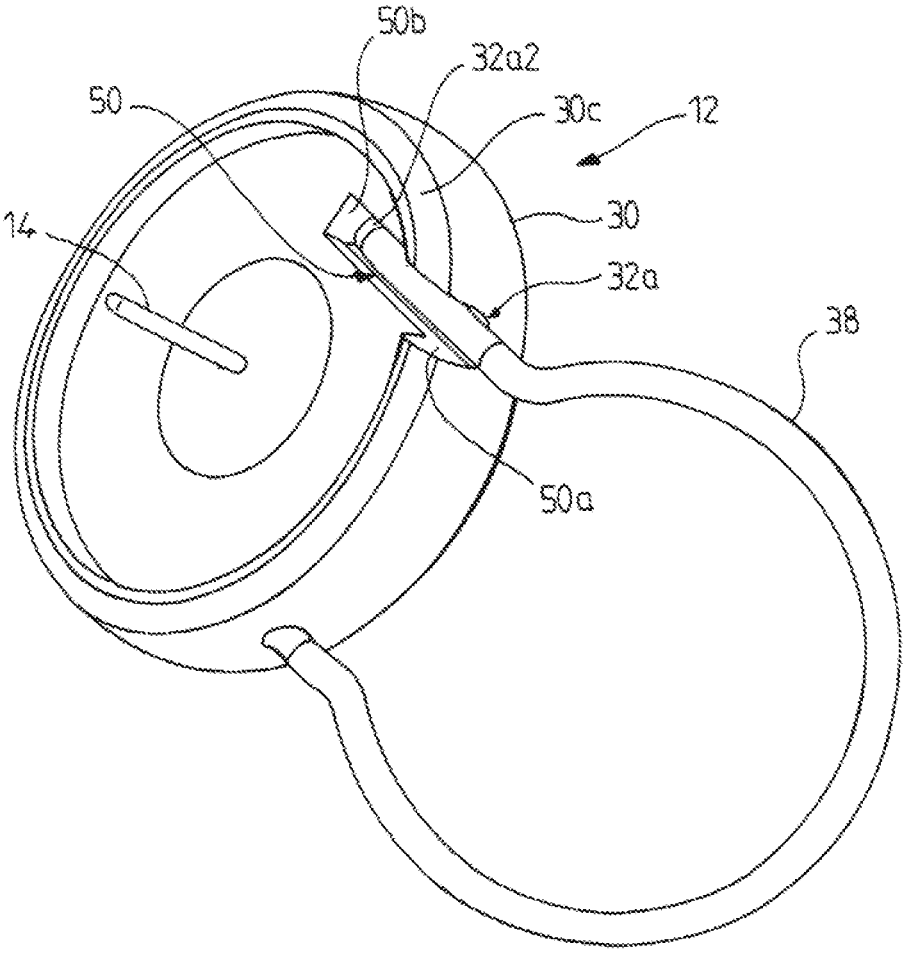
FIG. 6 is a perspective view of the attachment part from FIG. 3 with the attachment member in the closed position.

A housing 50 is provided in the body 30 of the attachment part 12 (FIG. 3) at a distance from the axial spike 14. This housing enables reception of the first end 32*a* of the attachment member 32 (FIG. 6) following pivoting thereof about the second end 32*b* (this end constitutes a pivot pin) that is fixed in an articulated manner to the attachment part (FIG. 5). The pivoting is effected freely between a first position in which the first end 32*a* is far away from the body 30 (FIG. 3) and a second position in which the first end 32*a* is disposed in the housing 50 (FIG. 6). The pivoting occurs in a plane perpendicular to the face of the attachment part from which the axial spike 14 extends (this plane contains the axial spike). In the absence of the part 16 the first end 32*a* is free to leave its housing and to return at leisure into its first position.

More particularly, the housing 50 takes the form of an axial notch through the entire thickness of the body and opening onto its exterior circumference (FIGS. 1 and 3) at an open end 50*a*. The notch also opens onto the internal face 30*a* so that the first end 32*a* can enter it. The annular rim 30*c* is locally interrupted by this notch (FIGS. 3 and 6). The notch 50 includes in the vicinity of the opposite end 50*b* a depression 50*c* in the end wall of the notch that is parallel to the lower face 30*a*. This depression is intended to receive the curved terminal part 32*a*2 in the second position of the attachment member 32 (FIG. 6). This arrangement therefore prevents forcible axial withdrawal (this refers to the axis of the housing) of the first end 32*a* from its housing 50.

In this embodiment, the cavity 40 and the housing 50 are parallel to each other to receive the second end 32*b* and the first end 32*a*, respectively.

The attachment part 12 (FIG. 1) also includes a cap 52, for example a transparent cap, which is inserted in the body 30, inside an internal area delimited by a second annular rim 30*e*. The second rim 30*e* extends in the opposite direction to the first rim 30*c*. With the rear face 30*f* of the body 30 opposite the front interior face 30*a* the cap 52 delimits a partially hollow space. The cap is nested or screwed or otherwise removably fixed to the body 30 in order to be able to access the rear face 30*f*, for example to mount/demount the axial retaining assembly from FIG. 5 (the cap is not represented in FIG. 5 for reasons of simplification).

The space situated behind the cap 52 (between the latter and the rear face 30*f*) can for example accommodate an additional element bearing information as described in French patent n° 2 947 087.

Figure 7A:
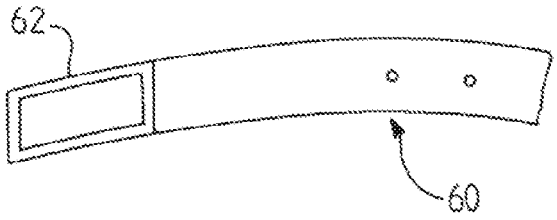
FIGS. 7*a-c* are diagrammatic views showing the attachment of the device from FIGS. 1 to 6 to a belt.

When it is required to attach the attachment part 12 of the device to a commercial article such as a belt 60 partly represented in FIG. 7*a*, the free end 32*a* of the member is moved away from the body 30 (open first position identical to that of FIG. 3).

Figure 7B:
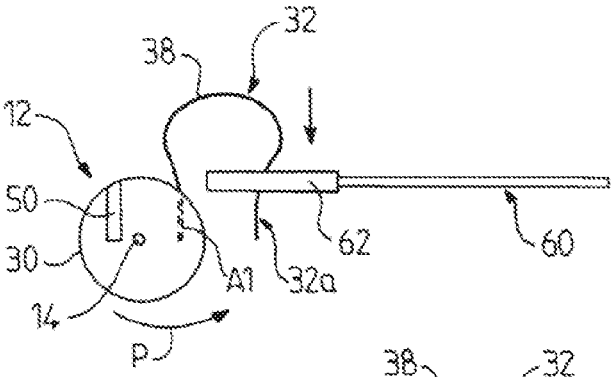

For example, the free first end 32*a* is introduced into the interior of the buckle 62 of the belt to exit it on the other side in order to trap the buckle 62 inside the curved portion 38 (body of the member) (FIG. 7*b*). As indicated by the arrow P, the body 30 then pivots about the pivot axis Al shown in dashed outline (second end 32*b* of the attachment member 32) in order for the free first end 32*a* to penetrate into the housing 50.

Figure 7C:
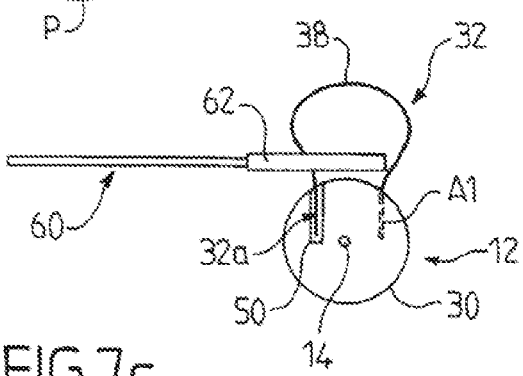

FIG. 7*c* is a view from the side opposite that of the FIG. 7*b* view after this pivoting.

In this second position, the free first end 32*a* is not fixed and is free to leave the housing 50.

This first phase (attachment phase) is particularly simple and quick to carry out and can be effected with one hand.

To lock the first attachment part 12 of the device 10 to the article 60, the second part 16 of the device is moved against the first attachment part 12. The axial insertion orifice 20 of the second part is position facing the axial spike 14 and is pushed onto the spike until the spike is locked by the conventional locking means 22 described above. This second phase (blocking phase) is also particularly simple and quick to carry out.

In this locked position shown in FIGS. 1 and 2, the second part 16 is nested inside the hollow or recess 30*d* formed on the interior face of the first part 12. The face 18*b* of the second part is therefore caused to bear against the interior (front) face 30*a* of the first part 12, at least: in the region of the opening of the housing 50 that opens onto the face 30*a*. The free first end 32*a* is therefore blocked in its housing by the face 18*b* of the second part 16 which is itself locked to the first part 12 by the locking means.

Because the spike 14 no longer serves to perforate the articles but only to be inserted in the orifice 20 of the second part, this spike no longer needs to be as pointed as previously. It can therefore be blunted whilst being as thin as before, which can easily be achieved starting from a conventional second part 16 "recycled" for the requirements of the present invention. The spike is also blunted to prevent inadvertent scratching of the article during the various manipulations.

Alternatively, if the second part must be designed specifically for this new use in combination with the new first part, the spike may be designed from the outset as less thin than previously.

In the arrangement shown in FIGS. 1 and 2, the presence of the annular rim 30*c* bordering the interface area between the two parts 12 and 16 of the device prevents access to this area and therefore unwanted separation of these parts. This arrangement strengthens the tamper-proof nature of the device 10 (its inaccessibility from the outside).

In a first variant embodiment that is not shown, the spike 14 is carried by the second part 16 whereas the orifice for insertion of the spike is arranged in the first part 12 that also carries the means for locking the spike. The structure of the first attachment part is modified accordingly, and in particular the thickness of the body 30 is increased to receive the spike and the locking means.

In accordance with a second variant that is not shown, the annular rim 30*c* for protecting the interface between the two parts is arranged at the periphery of the second part 16 instead of the first part.

In this new configuration the outside dimensions of the first part 12 may be reduced in order for the annular rim forming a skirt of the second part 16 to cap the first part.

Alternatively, the outside dimensions of the first part 12 are not modified but an annular "trench" is produced in the internal face 30*a* of the first part in order to accommodate therein the annular rim of the second part.

In accordance with a third variant that is not shown, the anti-theft member 23 or each of the anti-theft members 23 is accommodated in the first attachment part 12 instead of the second part.

This arrangement may necessitate modification of the structure of the two parts.

Figure 8:
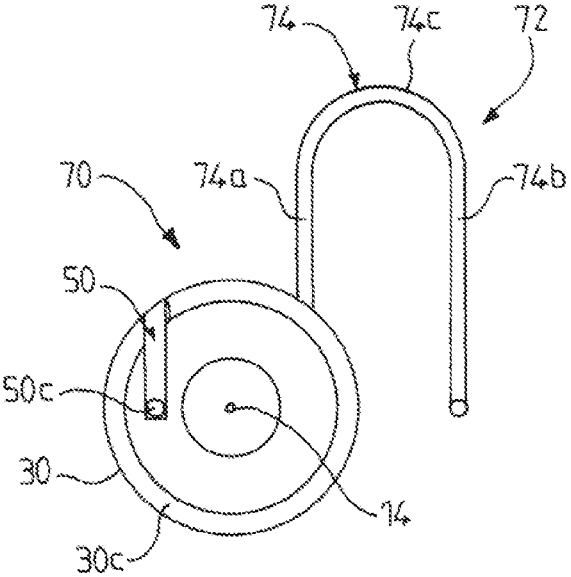
FIG. 8 is a front view of an attachment part in accordance with a second embodiment.

FIG. 8 shows a second embodiment in which the attachment part 70 differs from the attachment part 12 from FIG. 3 by the shape of the attachment member 72. The other elements are identical and retain the same references.

The curved part 74 of the attachment member has the shape of a padlock shackle with two parallel rectilinear sections 74*a*, 74*b* and a section 74*c* of circular arc shape (e.g. semicircular shape).

The attachment member still has the general shape of a hook when in the open position (FIG. 8), which enables it to be attached to the buckle of a belt, for example, to a handbag rope/strap, to a suitcase handle, etc.

The shape difference between the curved portions 38 and 74 from FIGS. 3 and 8, respectively, makes it possible to adapt to the shape of the commercial articles or at least to the shape of the portions of those articles to which the attachment parts of the devices must be fixed.

Figure 9A:
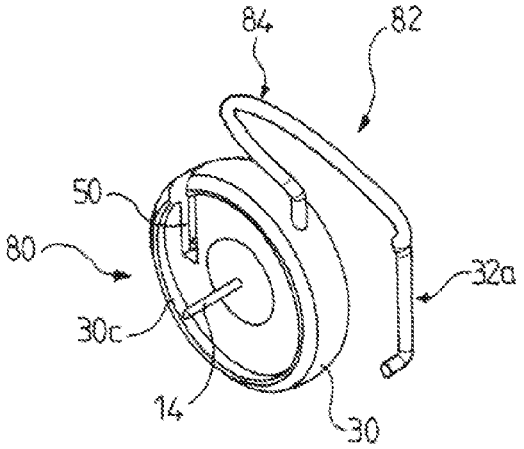
FIGS. 9*a* and 9*b* are diagrammatic perspective and lateral views of an attachment part in accordance with a third embodiment.
Figure 9B:
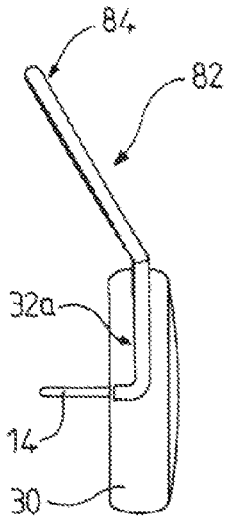

FIGS. 9*a* and 9*b* show a third embodiment in which the attachment part 80 differs from the attachment part 12 (FIG. 3) by the shape of the attachment member 82. The other elements are identical and retain the same references.

The curved portion 84 lies in a plane that is inclined relative to the plane in which lie the opposite first and second ends, of which only the free first end 32*a* is shown.

The inclination relative to the body of the attachment part 80 is seen better in the FIG. 9*b* profile view. This inclination facilitates the placement of the attachment part on certain articles according to the shapes thereof.

Moreover, the cranked shape of the attachment part 80 can adapt more easily to an article that has external surfaces that are not necessarily plane. Accordingly, once the attachment part 80 and its complementary second part 16 have been installed on the article, the device espouses the contours of the article better than if the attachment member 82 were not inclined.

For example, if the device is attached to a belt that is suspended from a display, the attachment member 82 is inclined to pass through and wrap around the buckle, whereas the body of the device is arranged vertically along the vertically suspended belt.

It will be noted that when the body of the device carries information intended to be read by the customers of a shop, the inclination of the attachment member 82 can make the information easier to read, notably if the latter is visible through the transparent cap (or window) 52 from FIG. 1 or through a protective film.

The inclination either toward the front face 30*a* of the body, i.e. in the direction of the spike (FIG. 9*b*), or toward the opposite rear face depends on the article to which the device must be locked, the presence or absence of information to be read on the device, and the location thereof.

The inclination angle in FIGS. 9*a* and 9*b* is 40°, for example. The value of this angle may vary, however, notably as a function of the commercial article to which the device must be locked.

It will be noted that in the case of articles of large size such as handbags the inclination of the attachment member 82 can also facilitate unlocking the device on an unlocking machine such as a magnetic decoupler (with a permanent magnet).

A fourth embodiment of an attachment part 100 is shown in FIGS. 10*a-e*.

The attachment part includes a body 102 to which an attachment member 104 is fixed in an articulated manner.

The attachment member 104 has the general shape of a hook but is different from that from FIG. 3.

It essentially comprises a curved circular portion (body) 106 subtending an angle greater than 180° and two opposite ends, of which only the free first end 104*a* is shown. The second end is identical to the second end 32*b* arranged in the cavity 40 from FIG. 5 that serves as a pivot.

The free first end 104*a* is shortened relative to the free end 32*a* from FIG. 3.

The curved portion 106 is generally of smaller diameter than the curved portion 38 from FIG. 3 (the diameter of the curved portion 38 substantially corresponds to that of the body 30). This smaller diameter (smaller overall size) makes it possible to attach it to an area of the article of relatively small size. Once attached to the article, the device 100 takes up little room.

Figure 10A:
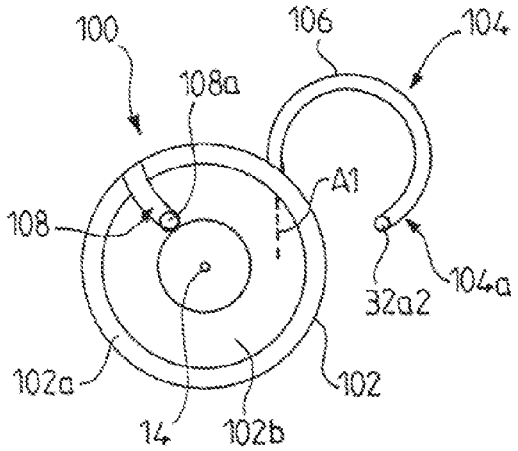
FIGS. 10*a-d* are diagrammatic views of an attachment part in accordance with a fourth embodiment in different orientations.
Figure 10B:
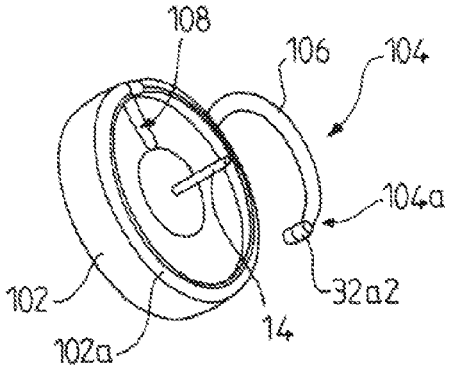
Figure 10C:
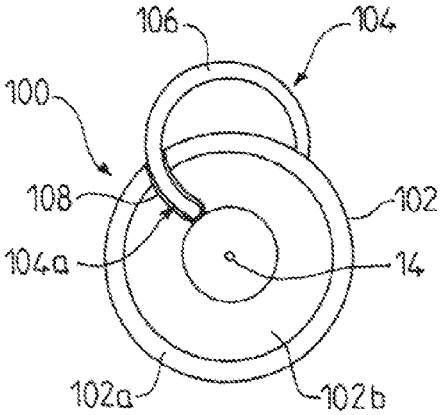

Moreover, the curved portion partially penetrates into the interior of the body 102 in the pivoted/closed position (FIG. 10*c*). This is not the case in the embodiment of FIGS. 1 to 6 in which the curved portion 38 is arranged entirely outside the body of the device, therefore making it possible to free up a larger space inside the curved portion.

In FIGS. 10*a-d*, the free first end 104*a* comprises a part of the curved portion 106 and a curved terminal part 106*a*1 identical to the terminal part 32*a*2 from FIG. 3.

This free first end 104*a* is intended to be inserted in a housing or notch 108 of the body 102 (FIG. 10*c*) in order to close the hook/loop and to be able to trap/surround an article.

The housing 108 (far away from the spike 14) has an arcuate shape corresponding to the curvature of the free first end 104*a* in order to receive the latter.

The body 102 includes an (optional) annular rim 102*a* similar to the rim 30*c* from FIG. 3, locally interrupted by the housing 108 and delimiting an internal recess or hollow 102*b* similar to the recess or hollow 30*d*.

As shown diagrammatically in FIG. 10*a*, the orientation of the cavity materially represented by the pivot axis A1 and the general or average orientation of the housing 108 are not parallel to each other but form a non-zero angle.

Figure 10D:
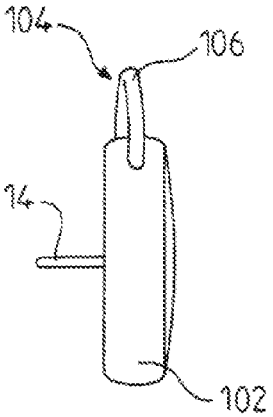
Figure 10E:
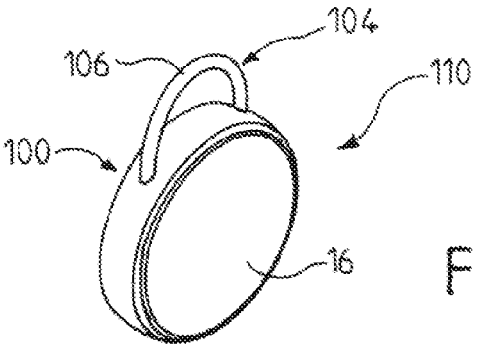
FIG. 10*e* is a perspective view of a device formed from the attachment part from FIGS. 10*a-d;*

The curved portion 106 of the attachment member 104 is not plane and does not lie in a plane perpendicular to the spike 14, but has a certain twist that can be seen in FIGS. 10*d* and 10*e*. In other words, the curved portion extends from one end to the other across the thickness of the body 102. This twist facilitates placement of the curved portion on certain articles such as shoes.

The virtually round shape of the curved portion 104, its diameter less than the diameter of the body 102 and the twisted or warped shape enable it to be easily inserted through the eyelets of a shoe.

The shape of this attachment member therefore enables it to be attached easily by its curved portion forming a hook/loop through two adjacent eyelets of a shoe, i.e. in an area of relatively small size compared to that of the attachment area of the attachment part 12 (FIG. 3).

FIG. 10*e* shows a device 110 comprising the attachment part 100 and the second part 16 from FIGS. 1 and 2 assembled together in a locked manner in order to block the attachment member/hook 104 in the closed position (in exactly the same way as described for the previous embodiments and variants).

Figure 11:
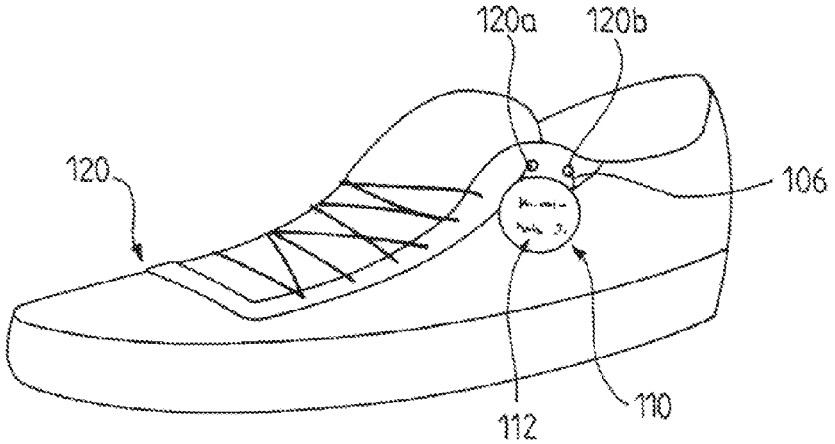
FIG. 11 is a diagrammatic view showing the attachment of the device from FIG. 10*e* to a shoe.

FIG. 11 shows the device 110 fixed in a locked manner to a shoe 120 (e.g. a basketball shoe) by passing the curved portion (loop or ring) 106 through two adjacent eyelets 120*a*, 120*b*.

The device 110 may equally carry information 112 on the external face of the second part 16 (FIG. 10*e*) or protected behind a transparent interface.

It will be noted that the variants described in relation to the first embodiment apply equally to the other embodiments.

The various embodiments may equally be combined with one another.

For example, the curved portion 74 of the attachment member 72 (FIG. 8) may therefore be inclined relative to the body 30 of the attachment part, as in the embodiment of FIGS. 9*a* and 9*b*.

The invention claimed is:

1. Device for marking a packaged or unpackaged commercial article, the device comprising:

two separable parts, a first part that includes an axial spike; and a second part that includes an orifice for the axial insertion of the spike and locking means that are able to lock the spike of the first part inserted axially in said orifice and to prevent its axial withdrawal, wherein one of the two parts, referred to as the attachment part, includes a rigid attachment member that includes a body having a free first end and an opposite second end fixed in an articulated and permanent manner to the attachment part, the free first end being able to pivot freely about the second end in the absence of the other part of the device between a first position in which the free first end is far away from the attachment part and a second position in which the free first end is disposed in a housing of the attachment part that is far away from the spike or the orifice for axial insertion of the spike, the attachment part being configured so that the free first end of the attachment member is blocked in the housing and prevented from pivoting by the presence of the other part of the device that is locked to the attachment part by way of the spike and its locking means.

2. Device according to claim 1, wherein the attachment member has the general shape of a hook.

3. Device according to claim 1, wherein the second end of the attachment member is mounted so that it is free to rotate about its axis inside a cavity of the attachment part and is retained axially in position in said cavity.

4. Device according to claim 3, wherein the body of the attachment member that is outside the attachment part is joined to the second end through an opening of the attachment part that leads into the cavity.

5. Device according to claim 3, wherein the housing for the first end and the cavity for the second end are arranged in a parallel manner.

6. Device according to claim 3, wherein the housing for the first end and the cavity for the second end are oriented in respective non-parallel directions.

7. Device according to claim 3, wherein the opening of the housing is on a face of the attachment part, the other part of the device facing said face when it is locked to said attachment part, and wherein the rotation axis of the second end of the attachment member is contained in a plane substantially parallel to that in which the opening lies.

8. Device according to claim 3, wherein the housing of the attachment part includes an opening through which the free first end of the attachment member is able to penetrate into said housing and free to leave it in the absence of the other part of the device, and wherein the rotation axis of the second end of the attachment member is contained in a plane substantially parallel to that in which the opening lies.

9. Device according to claim 1, wherein the housing of the attachment part includes an opening through which the free first end of the attachment member is able to penetrate into said housing and free to leave it in the absence of the other part of the device.

10. Device according to claim 9, wherein the opening of the housing is on a face of the attachment part, the other part of the device facing said face when it is locked to said attachment part.

11. Device according to claim 1, whrerein the two parts of the device are configured so that when they are locked together the interface between said parts that is perpendicular to the axial spike (14) is protected from the outside by an axial extension (30*c*) fastened to one of the parts that surrounds said interface.

12. Device according to claim 1, wherein in the spike is blunted.

13. Device according to claim 1, wherein the attachment member comprises a first portion including the opposite first end and second end and a curved second portion that extends from the first portion and forms the body of the attachment member.

14. Device according to claim 13, wherein the curved second portion lies in a plane that coincides with the plane in which the first portion lies.

15. Device according to claim 13, wherein the curved second portion lies in a plane that is inclined relative to the plane in which the first portion lies.

16. Device according to claim 13, wherein the curved second portion of the attachment member has a circular arc or hoop shape.

17. Device according to claim 1, wherein the free first end of the attachment member includes an end portion curved to form a retaining element intended to cooperate with the housing of the attachment part.

18. Device according to claim 1, wherein the attachment part is the first part of the device.

19. Device according to claim 1, wherein the attachment part is the second part of the device.

20. Device according to claim 1, wherein the device is an anti-theft protection device.

21. Device according to claim 20, wherein at least one of the two parts includes at least one active or passive member that is able to emit electromagnetic waves to the outside of the device or to receive electromagnetic waves from the outside of the device.

22. Device according to claim 21, wherein said at least one active or passive member is housed in the other part of the device.

23. Device according to claim 1, wherein one of the two parts contains an ink reservoir that is able to release ink in the event of attempted axial withdrawal of the spike from the second part.

24. Device according to claim 1, wherein said axial spike has a blunted tip.

25. Device for marking a packaged or unpackaged commercial article, said device comprising:

an axial spike; and a rigid attachment member intended for attaching the device to a commercial article or to its packaging, the attachment member including a body having a free first end and an opposite second end fixed in an articulated and permanent manner to the device, the free first end being able to pivot about the second end between a first position in which the free first end is far away from the device and a second position in which the free first end is disposed in a housing of the device that is far away from the axial spike, the free first end being able to pass freely from one position to the other during its pivoting movement.

26. Device according to claim 25, wherein the axial spike is intended to cooperate with and to be locked to a device complementary to the marking device, the free first end being able to pass freely from one position to the other when the axial spike is not cooperating with said complementary device.

* * * * *